US010859295B2

(12) United States Patent
Hepp et al.

(10) Patent No.: US 10,859,295 B2
(45) Date of Patent: Dec. 8, 2020

(54) COOLING AND HEATING PLATFORM

(71) Applicant: ZeoThermal Technologies LLC, Longmont, CO (US)

(72) Inventors: James A. Hepp, Longmont, CO (US); Steven A. Schechter, Longmont, CO (US); Edward A. Perkins, Franktown, CO (US); David L. Basinger, Loveland, CO (US)

(73) Assignee: ZeoThermal Technologies, LLC, Longmont, CO (US)

( * ) Notice: Subject to any disclaimer, the term of this patent is extended or adjusted under 35 U.S.C. 154(b) by 44 days.

(21) Appl. No.: 15/486,105

(22) Filed: Apr. 12, 2017

(65) Prior Publication Data

US 2017/0299238 A1 Oct. 19, 2017

Related U.S. Application Data

(60) Provisional application No. 62/321,887, filed on Apr. 13, 2016.

(51) Int. Cl.
*F25B 29/00* (2006.01)

(52) U.S. Cl.
CPC ..... *F25B 29/00* (2013.01)

(58) Field of Classification Search
CPC ..... F25B 29/00; F25B 29/003; F25B 29/006
USPC ..... 165/279
See application file for complete search history.

(56) References Cited

U.S. PATENT DOCUMENTS

| | | | |
|---|---|---|---|
| 1,886,768 | A | 11/1932 | Watson |
| 1,958,899 | A | 5/1934 | MacAdams |
| 2,146,622 | A | 2/1939 | Simon |
| 2,413,386 | A | 12/1946 | Schulz |
| 2,510,125 | A | 6/1950 | Meakin |
| 2,531,074 | A | 11/1950 | Miller |
| 2,540,547 | A | 2/1951 | Rodert |
| 2,608,690 | A | 9/1952 | Kolb et al. |
| 2,703,770 | A | 3/1955 | Melzer |
| 2,726,658 | A | 12/1955 | Chessey |
| 2,954,898 | A | 10/1960 | Freeberg |

(Continued)

FOREIGN PATENT DOCUMENTS

| | | |
|---|---|---|
| CN | 2304378 | 1/1999 |
| CN | 1373649 A | 10/2002 |

(Continued)

OTHER PUBLICATIONS

Van Eps et al.; Equine laminitis: cryotherapy reduces the severity of the acute lesion; Equine Veterinary Journal; vol. 36; No. 3; pp. 255-260; Apr. 2004.

(Continued)

*Primary Examiner* — Tho V Duong
*Assistant Examiner* — Raheena R Malik
(74) *Attorney, Agent, or Firm* — Elevated IP, LLC

(57) ABSTRACT

A cooling and heating platform is disclosed. An example cooling and heating platform includes an operating chamber with an operating liquid in the operating chamber. The example cooling and heating platform includes a heat exchanger in the operating chamber. The heat exchanger exchanges heat between the operating liquid and an application fluid in the heat exchanger to maintain the application fluid at a predetermined temperature for an application.

5 Claims, 2 Drawing Sheets

(56) References Cited

U.S. PATENT DOCUMENTS 3,261,042 A 7/1966 Baker
3,320,682 A 5/1967 Sliman
3,354,898 A 11/1967 Barnes
3,470,943 A * 10/1969 Van Huisen ..... F24T 10/10 165/45
3,561,435 A 2/1971 Nicholson
3,738,367 A 6/1973 Hardy
3,744,555 A 7/1973 Fletcher et al.
3,830,676 A 8/1974 Elkins
3,871,381 A 3/1975 Roslonski
3,901,225 A 8/1975 Sconce
3,993,053 A 11/1976 Grossan
4,009,587 A * 3/1977 Robinson, Jr. ..... F25B 1/00 62/116
4,020,209 A 4/1977 Yuan
4,026,299 A 5/1977 Sauder
4,116,476 A 9/1978 Porter et al.
4,118,946 A 10/1978 Tubin
4,147,921 A 4/1979 Walter et al.
4,149,529 A 4/1979 Copeland et al.
4,149,541 A 4/1979 Gammons et al.
4,170,998 A 10/1979 Sauder
4,184,537 A 1/1980 Sauder
4,194,247 A 3/1980 Melander
4,335,726 A 6/1982 Kolstedt
4,338,944 A 7/1982 Arkans
4,375,831 A * 3/1983 Downing, Jr. ..... F24D 11/0214 165/48.1
D269,379 S 6/1983 Bledsoe
4,407,276 A 10/1983 Bledsoe
4,412,648 A 11/1983 Ford et al.
4,436,125 A 3/1984 Blenkush
4,460,085 A 7/1984 Jantzen
4,463,751 A 8/1984 Bledsoe
4,466,253 A * 8/1984 Jaster ..... F22B 3/045 60/686
4,471,759 A 9/1984 Anderson et al.
4,478,436 A 10/1984 Hashimoto
4,547,906 A 10/1985 Nishida et al.
4,550,828 A 11/1985 Baldwin et al.
4,556,457 A * 12/1985 McCord ..... B01D 3/00 134/12
4,597,384 A 7/1986 Whitney
4,678,027 A 7/1987 Shirey et al.
4,691,762 A 9/1987 Elkins et al.
4,699,613 A 10/1987 Donawick et al.
4,718,429 A 1/1988 Smidt
4,738,119 A 4/1988 Zafred
4,753,268 A 6/1988 Palau
4,765,338 A 8/1988 Turner et al.
4,817,588 A 4/1989 Bledsoe
4,834,073 A 5/1989 Bledsoe et al.
4,844,072 A 7/1989 French et al.
4,884,304 A 12/1989 Elkins
4,925,603 A 5/1990 Nambu
4,955,369 A 9/1990 Bledsoe et al.
4,955,435 A 9/1990 Shuster et al.
4,962,761 A 10/1990 Golden
4,964,282 A 10/1990 Wagner
4,964,402 A 10/1990 Grim et al.
4,966,145 A 10/1990 Kikumoto et al.
4,976,262 A 12/1990 Palmacci
4,996,970 A 3/1991 Legare
5,002,270 A 3/1991 Shine
5,014,695 A 5/1991 Benak et al.
5,022,109 A 6/1991 Pekar
5,033,136 A 7/1991 Elkins
5,052,725 A 10/1991 Meyer et al.
5,056,563 A 10/1991 Glossop
5,072,875 A 12/1991 Zacoi
5,074,285 A 12/1991 Wright
5,076,068 A 12/1991 Mikhail
5,080,089 A 1/1992 Mason et al.
5,080,166 A 1/1992 Haugeneder
5,086,771 A 2/1992 Molloy
5,097,829 A 3/1992 Quisenberry
5,104,158 A 4/1992 Meyer et al.
5,112,045 A 5/1992 Mason et al.
5,113,877 A 5/1992 Johnson, Jr. et al.
5,163,425 A 11/1992 Nambu et al.
5,163,923 A 11/1992 Donawick et al.
5,172,689 A 12/1992 Wright
5,186,698 A 2/1993 Mason et al.
5,201,552 A 4/1993 Hohmann et al.
5,230,335 A 7/1993 Johnson, Jr. et al.
5,232,020 A 8/1993 Mason et al.
5,241,951 A 9/1993 Mason et al.
5,243,706 A 9/1993 Frim et al.
5,269,369 A 12/1993 Faghri
D345,609 S 3/1994 Mason et al.
5,294,156 A 3/1994 Kumazaki et al.
D345,802 S 4/1994 Mason et al.
D345,803 S 4/1994 Mason et al.
5,303,716 A 4/1994 Mason et al.
5,305,712 A 4/1994 Goldstein
5,314,455 A 5/1994 Johnson, Jr. et al.
5,316,250 A 5/1994 Mason et al.
5,316,547 A 5/1994 Gildersleeve
D348,106 S 6/1994 Mason et al.
5,324,319 A 6/1994 Mason et al.
D348,518 S 7/1994 Mason et al.
D351,472 S 10/1994 Mason et al.
5,352,174 A 10/1994 Mason et al.
5,353,605 A 10/1994 Naaman
5,354,101 A 10/1994 Anderson, Jr.
5,354,103 A 10/1994 Torrence et al.
D352,781 S 11/1994 Mason et al.
5,372,575 A 12/1994 Sebastian
5,383,689 A 1/1995 Wolfe
RE34,883 E 3/1995 Grim
5,395,399 A 3/1995 Rosenwald
5,407,421 A 4/1995 Goldsmith
5,411,541 A 5/1995 Bell et al.
5,415,625 A 5/1995 Cassford et al.
5,417,720 A 5/1995 Mason
5,427,577 A 6/1995 Picchietti et al.
5,441,533 A 8/1995 Johnson et al.
5,449,379 A 9/1995 Hadtke
5,451,201 A 9/1995 Prengler
5,466,250 A 11/1995 Johnson, Jr. et al.
5,470,353 A 11/1995 Jensen
5,476,489 A 12/1995 Koewler
5,484,448 A 1/1996 Steele et al.
5,494,074 A 2/1996 Ramacier, Jr. et al.
5,496,358 A 3/1996 Rosenwald
5,507,792 A 4/1996 Mason et al.
5,509,894 A 4/1996 Mason et al.
5,514,081 A 5/1996 Mann
5,520,622 A 5/1996 Bastyr et al.
5,524,293 A 6/1996 Kung
5,527,268 A 6/1996 Gildersleeve et al.
5,533,354 A 7/1996 Pirkle
5,539,934 A 7/1996 Ponder
D372,534 S 8/1996 Andrews et al.
5,553,712 A 9/1996 Tisbo et al.
5,554,119 A 9/1996 Harrison et al.
5,556,138 A 9/1996 Nakajima et al.
5,564,124 A 10/1996 Elsherif et al.
5,569,172 A 10/1996 Padden et al.
5,592,694 A 1/1997 Yewer, Jr.
5,593,426 A 1/1997 Morgan et al.
5,630,328 A 5/1997 Hise et al.
5,634,886 A 6/1997 Bennett
5,634,940 A 6/1997 Panyard
5,638,707 A 6/1997 Gould
5,645,671 A 7/1997 Tillinghast
D382,113 S 8/1997 DuRapau
5,653,741 A 8/1997 Grant
D383,547 S 9/1997 Mason et al.
D383,848 S 9/1997 Mason et al.
5,662,239 A 9/1997 Heuvelman
5,662,695 A 9/1997 Mason et al.
5,672,152 A 9/1997 Mason et al.

(56) References Cited

U.S. PATENT DOCUMENTS

| | | | |
|---|---|---|---|
| 5,683,118 | A | 11/1997 | Slocum |
| 5,728,058 | A | 3/1998 | Ouellette et al. |
| 5,732,464 | A | 3/1998 | Lamont |
| 5,755,275 | A | 5/1998 | Rose et al. |
| 5,755,755 | A | 5/1998 | Panyard |
| 5,772,618 | A | 6/1998 | Mason et al. |
| 5,782,780 | A | 7/1998 | Mason et al. |
| 5,792,216 | A | 8/1998 | Kappel |
| 5,807,294 | A | 9/1998 | Cawley et al. |
| 5,827,208 | A | 10/1998 | Mason et al. |
| 5,833,638 | A | 11/1998 | Nelson |
| 5,862,675 | A | 1/1999 | Scaringe et al. |
| 5,865,841 | A | 2/1999 | Kolen et al. |
| 5,866,219 | A | 2/1999 | McClure et al. |
| 5,868,690 | A | 2/1999 | Eischen |
| 5,871,526 | A | 2/1999 | Gibbs et al. |
| 5,895,418 | A | 4/1999 | Saringer |
| 5,913,885 | A | 6/1999 | Klatz et al. |
| 5,920,934 | A | 7/1999 | Hannagan et al. |
| 5,951,598 | A | 9/1999 | Bishay et al. |
| 5,967,225 | A | 10/1999 | Jenkins |
| 5,968,072 | A | 10/1999 | Hite et al. |
| 5,970,519 | A | 10/1999 | Weber |
| 5,980,561 | A | 11/1999 | Kolen et al. |
| 5,984,885 | A | 11/1999 | Gaylord, Jr. et al. |
| 5,989,285 | A | 11/1999 | DeVilbiss et al. |
| 5,992,459 | A | 11/1999 | Sugita et al. |
| 5,997,495 | A | 12/1999 | Cook et al. |
| 6,030,412 | A | 2/2000 | Klatz et al. |
| 6,036,107 | A | 3/2000 | Aspen et al. |
| 6,036,718 | A | 3/2000 | Ledford et al. |
| 6,048,326 | A | 4/2000 | Davis et al. |
| 6,053,169 | A | 4/2000 | Hunt |
| 6,055,670 | A | 5/2000 | Parker |
| 6,074,413 | A | 6/2000 | Davis et al. |
| 6,083,256 | A | 7/2000 | Ovanesian |
| D430,288 | S | 8/2000 | Mason et al. |
| D430,289 | S | 8/2000 | Mason et al. |
| 6,105,382 | A | 8/2000 | Reason |
| 6,109,338 | A | 8/2000 | Butzer |
| 6,117,164 | A | 9/2000 | Gildersleeve et al. |
| 6,146,413 | A | 11/2000 | Harman |
| 6,156,059 | A | 12/2000 | Olofsson |
| 6,178,562 | B1 | 1/2001 | Elkins |
| 6,197,045 | B1 | 3/2001 | Carson |
| 6,228,106 | B1 | 5/2001 | Simbruner et al. |
| 6,238,427 | B1 | 5/2001 | Matta |
| 6,260,890 | B1 | 7/2001 | Mason |
| 6,261,314 | B1 | 7/2001 | Rich |
| 6,270,481 | B1 | 8/2001 | Mason et al. |
| 6,306,112 | B2 | 10/2001 | Bird |
| 6,328,276 | B1 | 12/2001 | Falch et al. |
| 6,352,550 | B1 | 3/2002 | Gildersleeve et al. |
| 6,354,635 | B1 | 3/2002 | Dyson et al. |
| 6,361,514 | B1 | 3/2002 | Brown et al. |
| 6,368,357 | B1 | 4/2002 | Schon et al. |
| 6,371,976 | B1 | 4/2002 | Vrzalik et al. |
| 6,382,678 | B1 | 5/2002 | Field et al. |
| 6,398,748 | B1 | 6/2002 | Wilson |
| 6,405,080 | B1 | 6/2002 | Lasersohn et al. |
| 6,406,445 | B1 | 6/2002 | Ben-Nun |
| 6,440,159 | B1 | 8/2002 | Edwards et al. |
| 6,443,498 | B1 | 9/2002 | Liao |
| 6,508,831 | B1 | 1/2003 | Kushnir |
| 6,547,284 | B2 | 4/2003 | Rose et al. |
| 6,551,264 | B1 | 4/2003 | Cawley et al. |
| 6,551,347 | B1 | 4/2003 | Elkins |
| 6,551,348 | B1 | 4/2003 | Blalock et al. |
| 6,616,620 | B2 | 9/2003 | Sherman et al. |
| 6,620,187 | B2 | 9/2003 | Carson et al. |
| 6,641,601 | B1 | 11/2003 | Augustine et al. |
| 6,645,232 | B2 | 11/2003 | Carson |
| 6,660,027 | B2 | 12/2003 | Gruszecki et al. |
| D486,870 | S | 2/2004 | Mason |
| 6,692,518 | B2 | 2/2004 | Carson |
| 6,695,872 | B2 | 2/2004 | Elkins |
| 6,699,267 | B2 | 3/2004 | Voorhees et al. |
| 6,719,713 | B2 | 4/2004 | Mason |
| 6,719,728 | B2 | 4/2004 | Mason et al. |
| 6,802,823 | B2 | 10/2004 | Mason |
| 6,818,012 | B2 | 11/2004 | Ellingboe |
| 6,823,682 | B1 | 11/2004 | Jenkins et al. |
| 6,871,878 | B2 | 3/2005 | Miros |
| 6,893,414 | B2 | 5/2005 | Goble et al. |
| 6,926,311 | B2 | 8/2005 | Chang et al. |
| 6,932,304 | B1 | 8/2005 | Villamar |
| 6,936,019 | B2 | 8/2005 | Mason |
| 6,942,015 | B1 | 9/2005 | Jenkins |
| 6,961,611 | B2 | 11/2005 | Dupelle |
| 7,001,417 | B2 | 2/2006 | Elkins |
| 7,008,445 | B2 | 3/2006 | Lennox |
| 7,017,213 | B2 | 3/2006 | Chisari |
| 7,025,709 | B2 | 4/2006 | Riggall |
| 7,044,960 | B2 | 5/2006 | Voorhees et al. |
| 7,052,509 | B2 | 5/2006 | Lennox et al. |
| 7,059,329 | B2 | 6/2006 | Mason et al. |
| 7,060,045 | B2 | 6/2006 | Mason et al. |
| 7,060,086 | B2 | 6/2006 | Wilson et al. |
| 7,093,903 | B2 | 8/2006 | O'Connor et al. |
| 7,107,629 | B2 | 9/2006 | Miros et al. |
| 7,108,664 | B2 | 9/2006 | Mason et al. |
| 7,117,569 | B2 | 10/2006 | Bledsoe |
| 7,125,417 | B2 | 10/2006 | Mizrahi |
| 7,141,131 | B2 | 11/2006 | Foxen et al. |
| 7,156,054 | B1 | 1/2007 | York |
| 7,166,083 | B2 | 1/2007 | Bledsoe |
| 7,191,798 | B2 | 3/2007 | Edelman et al. |
| 7,198,093 | B1 | 4/2007 | Elkins |
| 7,235,059 | B2 | 6/2007 | Mason et al. |
| 7,244,239 | B2 | 7/2007 | Howard |
| 7,306,568 | B2 | 12/2007 | Diana |
| 7,308,304 | B2 | 12/2007 | Hampton et al. |
| 7,326,196 | B2 | 2/2008 | Olsen et al. |
| 7,361,186 | B2 | 4/2008 | Voorhees et al. |
| 7,418,755 | B2 | 9/2008 | Bledsoe et al. |
| 7,434,844 | B2 | 10/2008 | Kao |
| 7,448,653 | B2 | 11/2008 | Jensen et al. |
| 7,479,122 | B2 | 1/2009 | Ceriani et al. |
| 7,485,103 | B2 | 2/2009 | Mason et al. |
| 7,490,620 | B2 | 2/2009 | Tesluk et al. |
| 7,500,957 | B2 | 3/2009 | Bledsoe |
| 7,640,764 | B2 | 1/2010 | Gammons et al. |
| 7,658,205 | B1 | 2/2010 | Edelman et al. |
| 7,694,693 | B1 | 4/2010 | Edelman et al. |
| 7,731,244 | B2 | 6/2010 | Miros et al. |
| 7,785,283 | B1 | 8/2010 | Bledsoe |
| 7,797,044 | B2 | 9/2010 | Covey et al. |
| 7,837,638 | B2 | 11/2010 | Miros et al. |
| 7,864,941 | B1 | 1/2011 | Bledsoe et al. |
| 7,871,427 | B2 | 1/2011 | Dunbar et al. |
| 7,896,910 | B2 | 3/2011 | Schirrmacher et al. |
| 7,908,692 | B2 | 3/2011 | Lange |
| 7,914,563 | B2 | 3/2011 | Mason et al. |
| 7,959,588 | B1 | 6/2011 | Wolpa |
| 7,959,657 | B1 | 6/2011 | Harsy |
| 7,988,653 | B2 | 8/2011 | Fout et al. |
| 8,052,628 | B1 | 11/2011 | Edelman et al. |
| 8,066,752 | B2 | 11/2011 | Hamilton et al. |
| 8,109,273 | B2 | 2/2012 | Golden et al. |
| 8,121,681 | B2 | 2/2012 | Hampton et al. |
| 8,182,521 | B2 | 5/2012 | Kane et al. |
| 8,216,163 | B2 | 7/2012 | Edelman |
| 8,216,290 | B2 | 7/2012 | Shawver et al. |
| 8,216,398 | B2 | 7/2012 | Bledsoe et al. |
| 8,226,698 | B2 | 7/2012 | Edelman et al. |
| 8,251,932 | B2 | 8/2012 | Fout |
| 8,251,936 | B2 | 8/2012 | Fout et al. |
| 8,273,045 | B2 | 9/2012 | Ceriani |
| 8,277,403 | B2 | 10/2012 | Ceriani et al. |
| 8,328,742 | B2 | 12/2012 | Bledsoe |
| 8,397,518 | B1 | 3/2013 | Vistakula |
| 8,414,512 | B2 | 4/2013 | Fout |
| 8,419,670 | B2 | 4/2013 | Downing |
| 8,425,579 | B1 | 4/2013 | Edelman et al. |

(56) References Cited

U.S. PATENT DOCUMENTS 8,444,581 B1 5/2013 Maxon-Maldonado et al.
8,512,263 B2 8/2013 Gammons
8,613,762 B2 12/2013 Bledsoe
9,066,781 B2 6/2015 Muehlbauer et al.
9,345,614 B2 5/2016 Schaefer et al.
9,402,763 B2 8/2016 Bledsoe
9,566,187 B2 2/2017 Edelman et al.
10,426,655 B2 10/2019 Schaefer et al.
2001/0018604 A1 8/2001 Elkins
2001/0034545 A1 10/2001 Elkins
2001/0034546 A1 10/2001 Elkins
2001/0039439 A1 11/2001 Elkins et al.
2002/0019657 A1 2/2002 Elkins
2002/0026226 A1 2/2002 Ein
2002/0032473 A1 3/2002 Kushnir et al.
2002/0041621 A1 4/2002 Faries et al.
2002/0058975 A1 5/2002 Bieberich
2002/0082668 A1 6/2002 Ingman
2002/0093189 A1 7/2002 Krupa
2002/0108279 A1 8/2002 Hubbard et al.
2002/0184784 A1* 12/2002 Strzala ..... B01D 3/10 34/60
2003/0060761 A1 3/2003 Evans et al.
2003/0196352 A1 10/2003 Bledsoe et al.
2004/0064170 A1 4/2004 Radons et al.
2004/0064171 A1 4/2004 Briscoe et al.
2004/0068309 A1 4/2004 Edelman
2004/0158303 A1 8/2004 Lennox et al.
2004/0162587 A1 8/2004 Hampton et al.
2004/0167594 A1 8/2004 Elkins
2004/0210283 A1 10/2004 Rose et al.
2004/0225341 A1 11/2004 Schock et al.
2004/0243202 A1 12/2004 Lennox
2005/0107855 A1 5/2005 Lennox et al.
2005/0126578 A1 6/2005 Garrison et al.
2005/0131324 A1 6/2005 Bledsoe
2005/0136213 A1 6/2005 Seth et al.
2005/0143796 A1 6/2005 Augustine et al.
2005/0143797 A1 6/2005 Parish et al.
2006/0058858 A1 3/2006 Smith
2006/0144557 A1 7/2006 Koscheyev et al.
2006/0156761 A1* 7/2006 Mola ..... B60H 1/3201 65/333
2006/0190062 A1 8/2006 Worthen
2006/0200057 A1 9/2006 Sterling
2006/0287697 A1 12/2006 Lennox
2007/0060987 A1 3/2007 Grahn et al.
2007/0108829 A1 5/2007 Lehn et al.
2007/0118194 A1 5/2007 Mason et al.
2007/0118965 A1 5/2007 Hoffman
2007/0157931 A1 7/2007 Parker et al.
2007/0161932 A1 7/2007 Pick et al.
2007/0161933 A1 7/2007 Ravikumar
2007/0167895 A1 7/2007 Gramza et al.
2007/0191918 A1 8/2007 Machold et al.
2007/0282230 A1 12/2007 Valderrabano et al.
2008/0000474 A1 1/2008 Jochle et al.
2008/0058911 A1 3/2008 Parish et al.
2008/0065172 A1 3/2008 Magdych
2008/0067095 A1 3/2008 Mueller
2008/0077211 A1 3/2008 Levinson et al.
2008/0097560 A1 4/2008 Radziunas et al.
2008/0097561 A1 4/2008 Melsky et al.
2008/0114406 A1 5/2008 Hampton et al.
2008/0132816 A1 6/2008 Kane et al.
2008/0132976 A1 6/2008 Kane et al.
2008/0161891 A1 7/2008 Pierre et al.
2008/0176199 A1 7/2008 Stickney et al.
2008/0188915 A1 8/2008 Mills et al.
2008/0234788 A1 9/2008 Wasowski
2008/0249593 A1 10/2008 Cazzini et al.
2008/0269852 A1 10/2008 Lennox et al.
2008/0275534 A1 11/2008 Noel
2008/0283426 A1 11/2008 Primer et al.
2009/0005841 A1 1/2009 Schirrmacher et al.
2009/0018623 A1 1/2009 Levinson et al.
2009/0038195 A1 2/2009 Riker et al.
2009/0062890 A1 3/2009 Ugajin et al.
2009/0069731 A1 3/2009 Parish et al.
2009/0183410 A1 7/2009 Tursso et al.
2009/0270930 A1 10/2009 Walker et al.
2010/0006631 A1 1/2010 Edwards et al.
2010/0076531 A1 3/2010 Beran et al.
2010/0121392 A1 5/2010 Stickney et al.
2010/0137951 A1 6/2010 Lennox et al.
2010/0139294 A1 6/2010 Lowe et al.
2010/0145421 A1 6/2010 Tomlinson et al.
2010/0161013 A1 6/2010 Heaton
2010/0217349 A1 8/2010 Fahey
2010/0241120 A1 9/2010 Bledsoe et al.
2010/0318143 A1 12/2010 Chapman et al.
2011/0004132 A1 1/2011 Cook
2011/0028873 A1 2/2011 Miros et al.
2011/0040359 A1 2/2011 Harris et al.
2011/0046700 A1 2/2011 McDonald et al.
2011/0048049 A1* 3/2011 Asai ..... F25B 30/06 62/260
2011/0087142 A1 4/2011 Ravikumar et al.
2011/0098792 A1 4/2011 Lowe et al.
2011/0098793 A1 4/2011 Lowe et al.
2011/0101117 A1* 5/2011 Miyauchi ..... B01D 53/1425 236/44 A
2011/0106023 A1 5/2011 Lowe
2011/0152982 A1 6/2011 Richardson
2011/0152983 A1 6/2011 Schirrmacher et al.
2011/0307038 A1 12/2011 Stiehr et al.
2012/0116272 A1 5/2012 Hampton et al.
2012/0143111 A1 6/2012 Bledsoe et al.
2012/0172774 A1 7/2012 Lowe et al.
2012/0179084 A1 7/2012 Lipshaw et al.
2012/0233736 A1 9/2012 Tepper et al.
2012/0245483 A1 9/2012 Lundqvist
2012/0288848 A1 11/2012 Latham et al.
2012/0330199 A1 12/2012 Lurie et al.
2013/0006154 A1 1/2013 Lowe
2013/0006335 A1 1/2013 Lowe
2013/0012847 A1 1/2013 Lowe et al.
2013/0013033 A1 1/2013 Lowe
2013/0123890 A1 5/2013 Latham
2013/0190553 A1 7/2013 Wong et al.
2013/0245519 A1 9/2013 Edelman et al.
2013/0245729 A1 9/2013 Edelman et al.
2013/0331914 A1 12/2013 Lee et al.
2014/0014292 A1* 1/2014 Rice ..... H05K 7/20745 165/11.1
2014/0046232 A1 2/2014 Sham et al.
2014/0142473 A1 5/2014 Lowe et al.
2014/0222121 A1 8/2014 Spence et al.
2014/0243939 A1 8/2014 Lowe et al.
2015/0075764 A1* 3/2015 Goth ..... H05K 7/20772 165/279
2015/0150717 A1 6/2015 Lowe et al.
2015/0366703 A1 12/2015 Du
2016/0038336 A1 2/2016 Hilton et al.
2016/0128865 A1 5/2016 Lowe
2016/0166428 A1 6/2016 Hilton et al.
2016/0350509 A1 12/2016 Sharma
2017/0145834 A1 5/2017 Lewis
2017/0299238 A1 10/2017 Hepp et al.

FOREIGN PATENT DOCUMENTS

CN 2880025 Y 3/2007
CN 201001805 Y 1/2008
CN 201070419 6/2008
CN 101524301 A 9/2009
DE 3343664 C1 3/1985
DE 3505274 A1 8/1986
DE 3637841 C1 2/1988
DE 4445627 A1 6/1996
DE 202004008515 U1 9/2004
DE 102006053451 A1 5/2008
DE 102006053452 A1 5/2008

(56) References Cited

FOREIGN PATENT DOCUMENTS

| | | | |
|---|---|---|---|
| DE | 102010022799 | A1 | 12/2011 |
| DE | 102010052449 | A1 | 5/2012 |
| DE | 102012002175 | A1 | 8/2013 |
| EP | 0344949 | A2 | 12/1989 |
| EP | 0412708 | A1 | 2/1991 |
| EP | 0535830 | A1 | 4/1993 |
| EP | 0861651 | B1 | 4/2002 |
| EP | 1329676 | A1 | 7/2003 |
| EP | 1393751 | A1 | 3/2004 |
| EP | 1972312 | A2 | 9/2008 |
| FR | 819022 | A | 10/1937 |
| IT | 330552 | | 10/1935 |
| JP | H08229061 | A | 9/1996 |
| JP | 2000288007 | A | 10/2000 |
| JP | 2002272773 | A | 9/2002 |
| KR | 200153967 | Y1 | 8/1999 |
| KR | 100654317 | B1 | 12/2006 |
| WO | 9213506 | A2 | 8/1992 |
| WO | 9215263 | A1 | 9/1992 |
| WO | 9409732 | A1 | 5/1994 |
| WO | 9626693 | A1 | 9/1996 |
| WO | 9721412 | A2 | 6/1997 |
| WO | 9807397 | A1 | 2/1998 |
| WO | 9944552 | A1 | 9/1999 |
| WO | 0023016 | A1 | 4/2000 |
| WO | 0055542 | A1 | 9/2000 |
| WO | 0067685 | A1 | 11/2000 |
| WO | 0154635 | A1 | 8/2001 |
| WO | 0219954 | A2 | 3/2002 |
| WO | 03072008 | A2 | 9/2003 |
| WO | 2005082301 | A1 | 9/2005 |
| WO | 2006110405 | A2 | 10/2006 |
| WO | 2011019603 | A1 | 2/2011 |
| WO | 2017223417 | A1 | 12/2017 |

OTHER PUBLICATIONS

Cothera LLC; VPULSE System Users Manual; 100149 Rev E; (C) 2013; 18 pgs. (manual rev. dated Jul. 2013).

Van Eps et al.; distal limb cryotherapy for the prevention of acute laminitis; Clin Tech Equine Pract; vol. 3; pp. 64-70; Mar. 2004.

International Search Report and Written Opinion for related PCT/US19/42720 dated Oct. 21, 2019.

* cited by examiner

COOLING AND HEATING PLATFORM

PRIORITY CLAIM

This application claims the benefit of U.S. Provisional Patent Application No. 62/321,887 filed Apr. 13, 2016 titled "Cooling and Heating Platform" of Hepp, et al., hereby incorporated by reference in its entirety as though full set forth herein.

BACKGROUND

Cooling and heating is provided for a wide array of different end-uses. These include, but are not limited in application to, the food industry (from farming, to food preparation, to food service), automotive, marine, and recreational vehicles, residential and commercial HVAC, manufacturing and fabrication, the military, and medical applications. Most cooling and heating systems involve heat transfer. That is, either heat is added or removed to provide the desired heating or cooling respectively.

DETAILED DESCRIPTION

Figure 1:
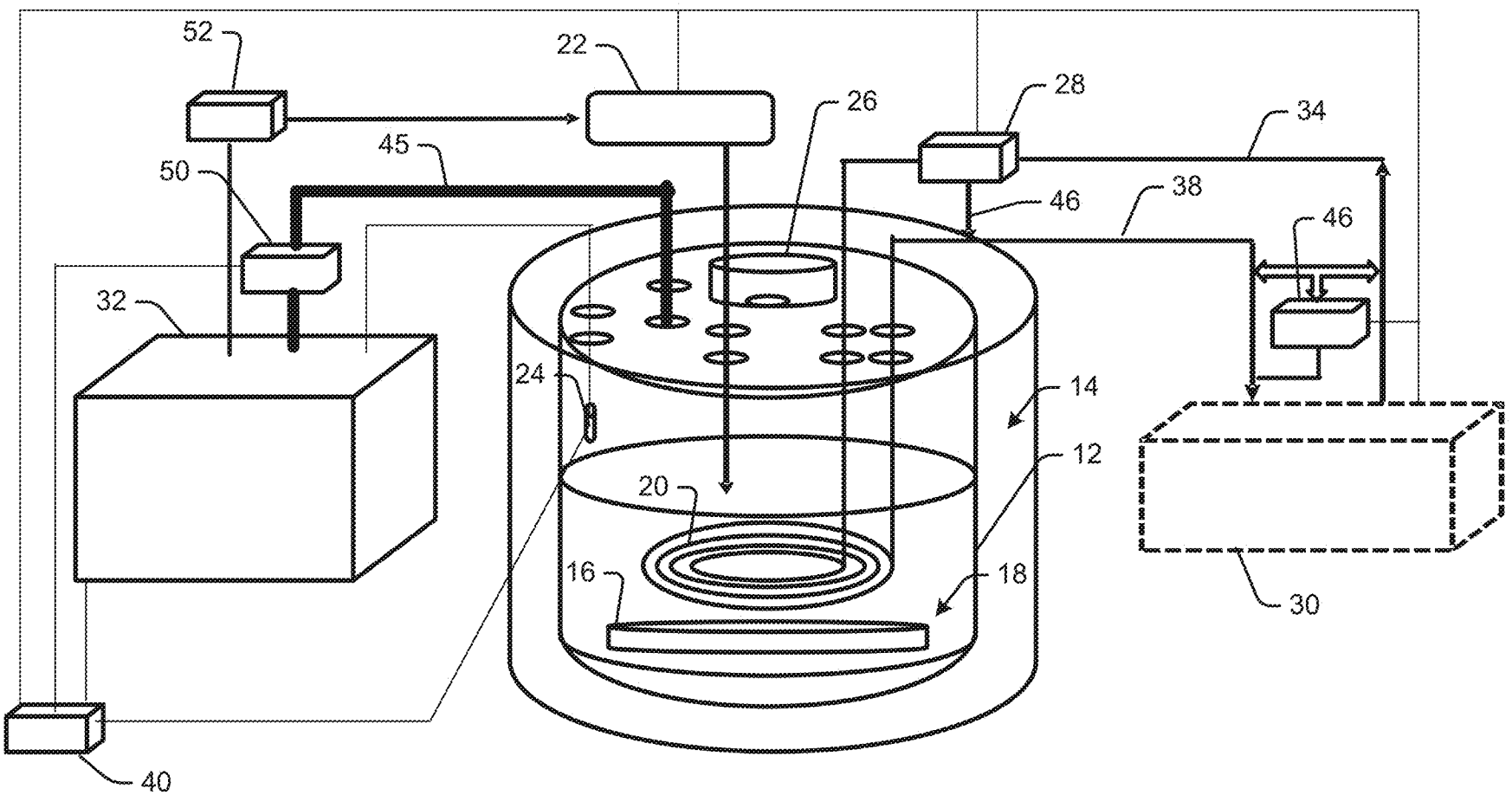
FIG. 1 is a diagrammatic overview of an example cooling and heating platform.

A cooling and heating platform is disclosed. In an example, the cooling and heating platform may be implemented as a cooling and heating platform that is inherently operating at a selected temperature, controlled via vacuum, hygroscopic, electrostatic system(s), and/or a heating element, e.g., in a combinatory manner. The cooling and heating platform may provide a scalable chilling and heating solution. The cooling and heating platform may be implemented in a wide variety of cooling, refrigeration, and/or heating applications.

In an example, the cooling and heating platform manages pressure within an operating chamber to maintain a steady operating temperature based on the boiling point of an "operating liquid." In an example, the operating liquid is an inexpensive and environmentally friendly "refrigerant."

By way of illustration, the refrigerant may be water-based and thus ecologically-friendly. An example water-based refrigerant includes, but is not limited to, distilled water. However, other operating liquids may also be implemented. Configurations utilizing a variety of other operating liquids can operate in different temperature ranges, allowing for heating and chilling solutions for an expanded range of applications.

Unlike standard refrigeration or ice, the example cooling and heating platform provides chilling to a specific temperature. The cooling and heating platform is not limited to extreme chilling that requires external control to achieve the desired temperature. This is a particularly important aspect in applications such as, but not limited to, physical therapy. In physical therapy, using too cold of a temperature (e.g., freezing) can have adverse health effects.

The cooling and heating platform is a viable replacement for many chilling/refrigeration devices that are based on the use of standard refrigerants (e.g., CFC's and their replacements). As such, cooling technologies based on the cooling platform may be implemented to reduce the climate impacts from world-wide use of CFC's and their replacements.

Before continuing, it is noted that as used herein, the terms "includes" and "including" mean, but is not limited to, "includes" or "including" and "includes at least" or "including at least." The term "based on" means "based on" and "based at least in part on."

The term "operating liquid" means any suitable matter to absorb energy via change of phase. The term "operating chamber" means any suitable partially or fully sealed vessel or container that houses a phase-change mechanism.

The term "heat exchanger" means a device used to transfer heat from one medium to another.

The term "application interface" means any mechanism that enables the transfer of thermal energy between the cooling/heating platform and an application that utilizes the heating/cooling provided by the platform. This may include but is not limited to an "application fluid" that physically transfers heat by flowing or circulating through a heat exchanger and the application.

In addition, the term "thermal battery" as used herein means any suitable device or matter to store thermal energy. A thermal battery, e.g. additional operating liquid, provides the ability to satisfy burst chilling/heating requirements that exceed the instantaneous capacity of the device.

The term "operating liquid supply" means a device that adds operating liquid to the operating chamber.

The term "hygroscopic material" means a material that adsorbs operating liquid vapor from the platform, e.g., from the operating chamber.

The term "electrostatic device" means a device that causes operating liquid vapor atoms/molecules to move in a desired path due to electrostatic fields, e.g., attracting ionized vapor to a anode or cathode for removal from the operating chamber.

The term "bypass switch" means a device that reroutes application fluid depending on the mode selected by the user.

The term "control system" means a system that monitors performance, maintains, displays and/or records the state, and controls the platform relative to a desired mode selected by the user.

The term "overpressure" means pressure above ambient atmospheric pressure.

FIG. 1 is a diagrammatic overview of an example cooling and heating platform 10. The example cooling and heating platform 10 includes a thermally isolated operating chamber 12. A thermal isolation layer 14 is provided around the operating chamber 12 and a heat exchanger 20. The operating chamber 12 includes a thermal battery 16 and an operating liquid 18.

The example cooling and heating platform 10 also includes an operating liquid supply 22. Example configurations of the cooling and heating platform 10 may include a total load of operating liquid 18, e.g., to sustain operation through a nominal operational period.

The operating liquid supply 22 may include a mechanism to reload and restart the device (e.g., open, refill, and then reestablish vacuum).

In another example, operating liquid 18 can be added during operation by introducing operating liquid 18 from the operating liquid supply 22 (e.g., an external source) directly into the operating chamber 12 without breaking vacuum.

Example implementations may include at least one sensor 24, e.g. temperature, pressure, or operating liquid level, on the interior of the operating chamber 12. A vapor removal mechanism 26 may be provided. A fluid circulating pump 28 may be provided to move the application fluid through the heat exchanger 20.

The cooling and heating platform 10 may be configured with one or more connectors that provide access to heat exchanger 20. The connectors may be commercially available (e.g., standard water hose connection), or specifically designed to a particular application. A pressure management device 32, e.g. a vacuum pump, and an operating liquid recovery mechanism 52 may be provided.

Control connections may be provided to control the pressure management device and operating liquid recovery mechanism 52 based on feedback from at least one sensor 24 for the operating chamber 12 and/or for the application 30 to a control system 40 to orchestrate any/all elements of the platform.

The cooling and heating platform 10 can be incorporated into any application 30 that utilizes traditional chilling/refrigeration, and can also be configured to support a wide range of cooling and heating applications. The cooling and heating platform also supports many, if not most, everyday chilling/refrigeration applications 30 and a range of cooling and/or heating applications 30. Examples of applications 30 include, but are not limited to an in-line fluid cooler/heater and a portable cold storage device An in-line fluid cooler/heater may have application to the following:

a. Liquor brewing (beer, whisky, etc.)—brewers struggle with cooling wort fast enough so as to mitigate wort loss and contamination.

b. Dairy farming—when cooling milk recovered during the dairy milking process, massive quantities of water are used to cool milk during delivery from collection to processing by pipes on the farm. The device eliminates all water waste by cooling collected milk before receipt by processing.

c. Breast milk processing—when breast milk is pumped, it must be cooled before refrigeration is allowed; current process takes longer than desired which risks contamination and loss. The device cools breast milk from body temperature to 40° F., ready for storage.

d. Food service (microbreweries, brew-pubs, restaurants)—Brew masters struggle with ways to improve the quality of the consumer's beer experience. Serving beer at the optimum temperature for taste is desirable but difficult. The device allows beer to be served at its intended or optimum temperature. In addition, in the fight for market share, breweries compete for a tap presence in restaurants, taverns, bars, etc. Other foods may require warming.

A portable cold storage device may have application to the outdoor recreation (boating, RV, hunting, camping, etc.) industry—Consumers want convenience and good products to enjoy their outdoor activities. During recreational activities, people are always running for more ice. Current built in boat coolers only hold ice for a few hours. With the cooling system retrofitted into an existing built-in cooler or incorporated into new cooler designs, purchasing a premium cooler will no longer be necessary.

A vacuum-based version as detailed above may have application to the following:

a. Commercial construction.

b. Residential construction.

c. Automotive (cars and RVs).

A version for manufacturing-based industries may have application to the following (e.g., for equipment and process cooling):

a. Plastics.

b. Foundries.

c. Printing.

d. Rubber.

e. Plating.

f. Machine Fabrication.

A food service version may have application to the following:

a. Residential refrigerators.

b. Food service walk-in coolers (restaurants, etc.).

c. Food retailers (grocery stores, wholesalers, liquor stores, etc.).

A medical or therapy-based version may have application to the medical (inpatient/outpatient, sports/physical therapy, etc.)—since the main premise in medicine is all about healing, the medical industry actively seeks faster recovery times in order to improve healing success rates. The device provides hot and cold therapy at therapeutic temperatures within specific limits determined to be medically safe.

A transportation-based version may have application to the following:

a. Medical (organ transport—ground or air).

b. Food (food transport—ground or air).

Example configurations of the cooling and heating platform 10 may be provided for different operating temperatures to support other chilling and/or heating applications. The operating liquid 18 may be selected based on design considerations, such as but not limited to, optimizing the ability to maintain the target operating temperature required for the application. Other considerations may include, but are not limited to, the pressure/vacuum and environmental/safety considerations of the operating liquid 18.

In an example, the cooling and heating platform 10 may be portable (e.g., hand carried), semi-portable (e.g., movable with the assistance of a hand truck, or similar), or fixed (e.g., requiring heavy equipment to be moved).

Example operation of the cooling and heating platform 10 is based on maintaining the pressure in a chamber or other vessel 12 containing the operating liquid 18 at a level of vacuum/overpressure (e.g., from pressure management device 32 and operating liquid recovery mechanism 52) such that the boiling point of the operating liquid 18 corresponds to the target chilling (or heating) temperature of the device or application 30. Chilling/refrigeration is provided by passing an application fluid to be chilled or heated (e.g., within return line 34) through a heat exchanger 20 (e.g., coils) immersed in the operating liquid 18 within the operating chamber 12 and to the application 30 (e.g., via supply line 38).

For the chilling configuration, having water as the operating liquid 18 in the operating chamber 12, the level of vacuum may be maintained by mechanical pumping and/or, for example, the use of hygroscopic materials, such as but not limited to these two, or similar mechanisms that remove water vapor from the operating chamber 12.

The chilling capacity of the cooling and heating platform 10 is determined primarily by the heat exchanger implementation and the capacity of the cooling and heating platform 10 for removing operating liquid vapor from the operating chamber 12. The platform may be configured to maintain the operating liquid in its liquid state in order to maximize the mixing effect of boiling, but configurations cause the operating liquid to change state to solid are also possible. Phase change of the subsequent solid form of the operating liquid back to liquid form (melting) and/or vapor (sublimation) may be incorporated into the operation of the platform.

For applications that require higher chilling capacities in bursts, the device may include a thermal battery 16 of additional operating liquid and/or other material(s) with suitable heat capacity that increases the heat capacity of the operating chamber 12 to the level desired to support the thermal load from burst chilling/heating. The normal chilling/heating function of the operating chamber 12 recharges the thermal battery 16 between bursts. The thermal battery may be located within the operating chamber 12 or externally.

The overall device behavior can be controlled with device control system 40 based on inputs from the device or application including, but not limited to, temperature, pressure, flow, and/or other sensors. The device control system 40 can operate attached devices, e.g., pressure management device 32, bypass switch 46, circulating pump 28, and operating liquid supply 22.

Operating chamber 12 is connected to pressure management device 32 through vacuum line 45.

For configurations where the operating chamber 12 is providing cooling, the heating bypass mechanism 46 can direct the application fluid to bypass the operating chamber 12 and pass through a heating element either integrated or external to heating bypass mechanism 46. This permits a single device to support heating and cooling applications separately or cyclically when alternating heating/cooling cycles are desired.

Before continuing, it should be noted that the examples described above for FIG. 1 are for purposes of illustration, and are not intended to be limiting. Other devices and/or device configurations may be utilized to carry out the operations described herein.

The example configuration of the cooling and heating platform 10 shown in FIG. 1 includes a thermally-isolated operating chamber 12. A thermal isolation layer 14 is provided around the operating chamber 12. The operating chamber 12 includes a thermal battery 16, an operating liquid 18, and a heat exchanger 20. The example cooling and heating platform 10 also includes a pressure management device 32 and an operating liquid supply 22.

In addition, the example cooling and heating platform 10 shown in FIG. 1 includes a vapor recovery system 50. The vapor recovery system 50 removes operating liquid 18 from vapor formed in the operating chamber 12 via operating liquid recovery mechanism 52. The operating liquid recovery mechanism 52 may include a mechanism to recycle operating liquid 18 by condensing the removed vapor (e.g., including any baked out of the hygroscopic material). The vapor recovery system 50 also returns the operating liquid 18 to an operating liquid supply 22 for return to the operating chamber 12.

In an example, the vapor removal system 50 includes hygroscopic material for removal of water vapor. Another example is where a vapor removal mechanism utilizes an electrostatic approach, similar to removing particulates from power plant and other exhausts (e.g., where the operating liquid 18 is not water-based).

Various configurations of the cooling and heating platform may permit recharging, reloading, and/or replacing vapor removal material in the vapor removal mechanism 50. The vapor removal material may include hygroscopic materials or their equivalent in non-water based configurations. An example vapor removal mechanism 50 may include the mechanical replacement of a "cartridge" containing the vapor removal material. Another example vapor removal mechanism 50 may include a mechanism to add additional fresh material to the liquid recovery system 52. An example vapor removal mechanism 50 may also include mechanism that seals a cartridge or other container of the liquid recovery system 52 from the operating chamber 12. The vapor removal material may be exposed to the atmosphere and then dried (e.g., via a heater, or some other method that is tailored to the specific material used in the configuration).

The operations shown and described herein are provided to illustrate example implementations. It is noted that the operations are not limited to the ordering shown. Still other operations may also be implemented.

Figure 2:
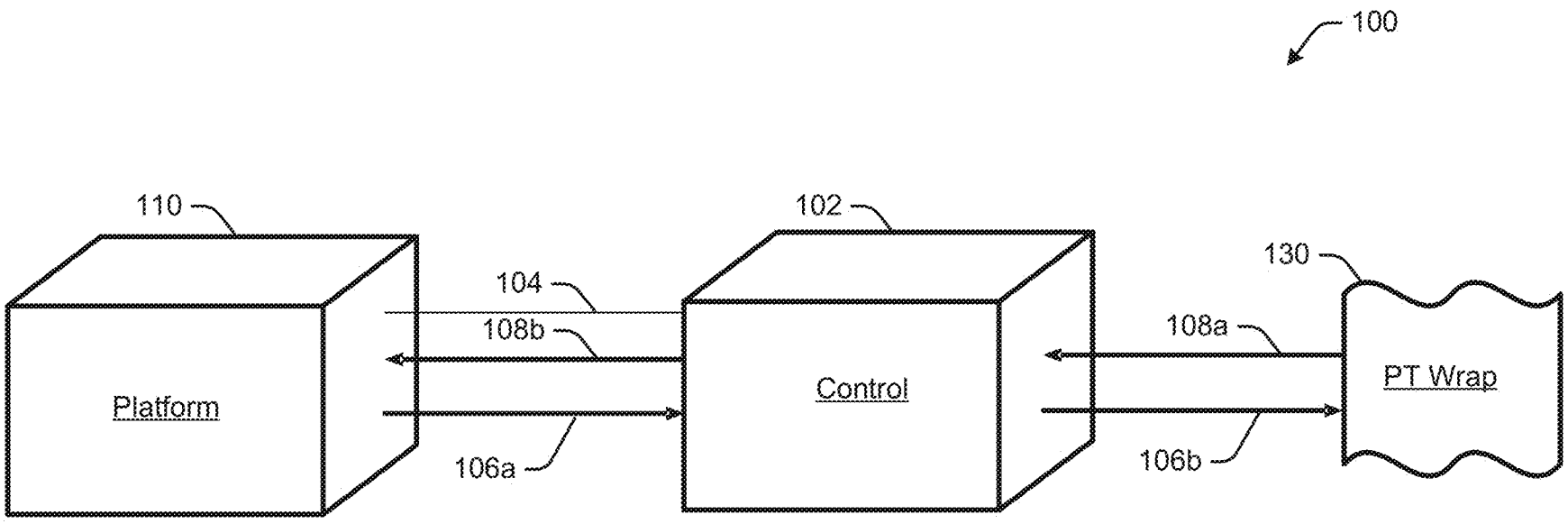
FIG. 2 illustrates an example application configuration of the cooling and heating platform.

FIG. 2 is diagram 100, illustrating an application configuration of the example cooling and heating platform (e.g., shown in FIG. 1). In this example, the cooling and heating platform is implemented as a cycling chiller/heater platform 110 and can be applied to a physical therapy application 130.

In an example, the physical therapy application 130 may include a therapy wrap (e.g., to be placed on a body, such as an ankle wrap). The cycling chiller/heater platform 110 may be operatively associated with a controller 102 for the therapy wrap. The controller may include control electronics and/or software to implement a thermal control and circulating pump.

The cycling chiller/heater platform 110 may receive feedback 104 from the controller 102. The feedback can be utilized to control temperature to the therapy application 130. Fluid output lines 106*a-b* deliver the temperature controlled application fluid to the physical therapy application 130 (e.g., the ankle wrap). Fluid return or input lines 108*a-b* return the application fluid to the chiller platform 110 to maintain the desired temperature.

Of course, the example shown and described with reference to FIG. 2 is only illustrative of an example implementation of the cooling and heating platform disclosed herein. Still other applications 130 are contemplated as being within the scope of this disclosure, whether specifically called out or not, as will be readily understood by those having ordinary skill in the art after becoming familiar with the teachings herein.

It is noted that the examples shown and described are provided for purposes of illustration and are not intended to be limiting. Still other examples are also contemplated.

The invention claimed is:

1. A heating and cooling platform for use with an application, the platform comprising:

an operating chamber for containing an operating liquid therein;

a sensor located within the operating chamber for sensing at least one of temperature, pressure, and an operating liquid level within the operating chamber;

a vacuum pump for adjusting a pressure within the operating chamber;

a vapor recovery system for removing operating liquid from vapor formed within the operating chamber; the vapor recovery system including a hygroscopic material for adsorbing the vapor from the operating chamber;

a heat exchanger containing an application fluid, the heat exchanger being located within the operating chamber and circulating the application fluid to the application;

a fluid circulating pump for moving the application fluid through the heat exchanger; and a control system connected with the sensor, the vacuum pump, the vacuum recovery system, and the fluid circulating pump, wherein the control system is configured for controlling the vacuum pump and the vapor recovery system such that the pressure within the operating chamber is maintained at a user selected pressure level in response to feedback received from the sensor such that a boiling point of the operating fluid corresponds to a target application temperature and, consequently, the application fluid is maintained at the target application temperature suitable for the application.

2. The platform of claim 1, further comprising a thermal isolation layer around the operating chamber.

3. The platform of claim 1, further comprising a thermal battery in the operating chamber, wherein the thermal battery is configured for satisfying at least one of a burst chilling and a burst heating requirement exceeding an instantaneous capacity of the platform.

4. The platform of claim 1 wherein the vapor recovery system is configured for condensing the removed vapor, and returning the operating liquid to the operating chamber.

5. The platform of claim 4, wherein the vapor recovery system includes an electrostatic device for removing vapor from the operating chamber, the electrostatic device being configured for causing liquid molecules within the vapor to move in a desired path using electrostatic fields by attracting ionized vapor to an electrode.

* * * * *